US006976750B2

(12) United States Patent
Ando

(10) Patent No.: US 6,976,750 B2
(45) Date of Patent: Dec. 20, 2005

(54) ELECTROSTATIC PRINTING DEVICE FOR ELECTROSTATIC PRINTING METHOD

(75) Inventor: Kesao Ando, Asaka (JP)

(73) Assignee: Berg Industry Co., Ltd., Saitama (JP)

( * ) Notice: Subject to any disclaimer, the term of this patent is extended or adjusted under 35 U.S.C. 154(b) by 19 days.

(21) Appl. No.: 10/478,126

(22) PCT Filed: May 20, 2002

(86) PCT No.: PCT/JP02/04838

§ 371 (c)(1),
(2), (4) Date: Nov. 20, 2003

(87) PCT Pub. No.: WO02/094568

PCT Pub. Date: Nov. 28, 2002

(65) Prior Publication Data

US 2004/0160505 A1 Aug. 19, 2004

(30) Foreign Application Priority Data

May 24, 2001 (JP) ..... 2001-155426

(51) Int. Cl.[7] ..... B41J 2/06
(52) U.S. Cl. ..... 347/55
(58) Field of Search ..... 347/11–112, 123, 347/125, 128, 141, 144, 147, 148, 156, 158, 347/164, 166, 168, 120

(56) References Cited

U.S. PATENT DOCUMENTS 6,030,069 A * 2/2000 Wakahara et al. ..... 347/55
6,398,345 B1 * 6/2002 Sakai et al. ..... 347/55

FOREIGN PATENT DOCUMENTS

| | | | |
|---|---|---|---|
| JP | 50-30610 | 3/1975 | |
| JP | 50-95014 | 7/1975 | |
| JP | 51-94311 | 8/1976 | ..... B41M 1/42 |
| JP | 57-167049 | 10/1982 | ..... G03G 15/00 |
| JP | 58-201689 | 11/1983 | ..... B41M 1/42 |
| JP | 62-97744 | 6/1987 | ..... B41F 15/08 |
| JP | 4-183360 | 6/1992 | ..... A23G 3/28 |
| JP | 5-24358 | 3/1993 | ..... B41F 15/08 |
| JP | 6-234204 | 8/1994 | ..... B41F 15/40 |
| JP | 8-1920 | 1/1996 | ..... B41F 35/00 |
| JP | 2001-138493 | 5/2001 | ..... B41F 35/00 |

* cited by examiner

*Primary Examiner*—Juanita D. Stephens
(74) *Attorney, Agent, or Firm*—Wenderoth, Lind & Ponack, L.L.P.

(57) ABSTRACT

The present invention relates to an electrostatic printing apparatus for rubbing powdery ink (44) into a screen (40) having a predetermined printed pattern (41) formed therein, and for applying a voltage between the screen (40) and an object (100) so as to attach the powdery ink (44) to the object (100). The electrostatic printing apparatus comprises a soft open-cell urethane sponge brush (42) to rub the powdery ink (44) into the screen (40), and a hard open-cell urethane sponge brush (43) to remove powdery ink solidified on a surface of the screen (40).

8 Claims, 7 Drawing Sheets

FIG. 7 - PRIOR ART
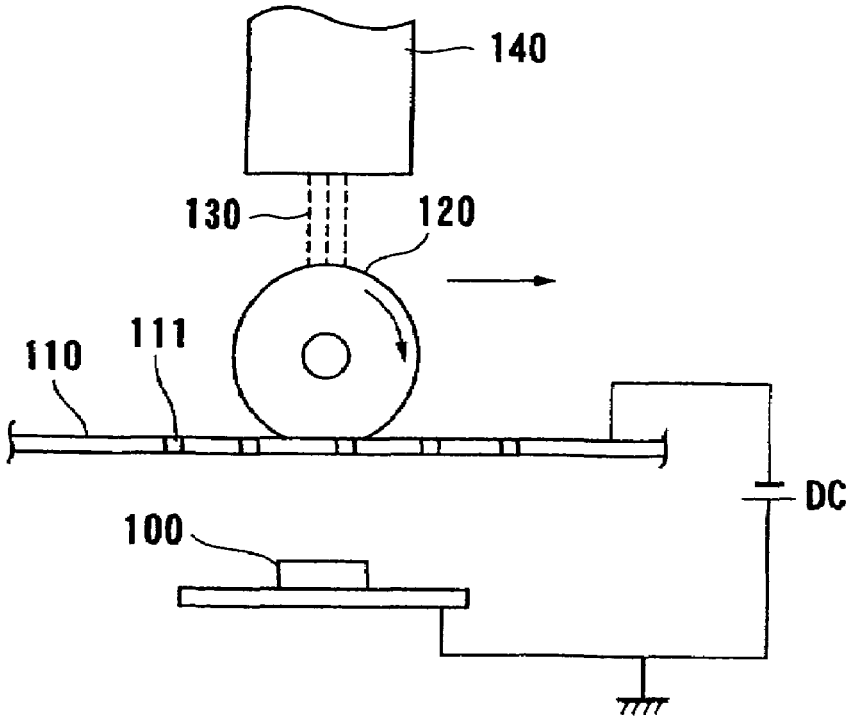
FIG. 8 - PRIOR ART
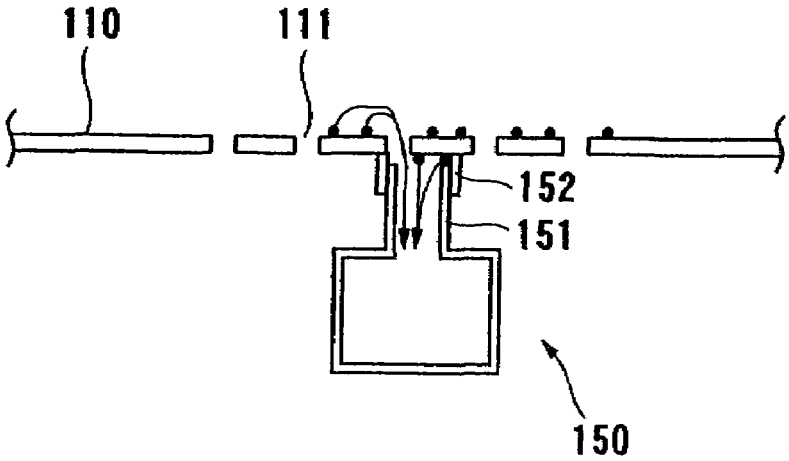

ELECTROSTATIC PRINTING DEVICE FOR ELECTROSTATIC PRINTING METHOD

This Application is a 371 of PCT/JPO2/04838, filed on May 20, 2002.

TECHNICAL FIELD

The present invention relates to an electrostatic printing apparatus and an electrostatic printing method, and more particularly to an electrostatic printing apparatus and an electrostatic printing method for attaching powdery ink onto a surface of an object by using an electrostatic force to print a printed pattern including characters and figures on the surface of the object.

BACKGROUND ART

There has heretofore been known an electrostatic printing apparatus for attaching powdery ink onto a surface of an object by using an electrostatic force to print a printed pattern including characters and figures on the surface of the object. FIG. 7 is a schematic diagram showing an arrangement of this type of electrostatic printing apparatus. The conventional electrostatic printing apparatus has a stencil screen 110 disposed above an object 100, a rotation brush 120 on the screen 110, and a hopper 140 for supplying powdery ink 130 onto the brush 120. A printed pattern including characters and figures is formed of a mesh 111 on the screen. The rotation brush 120 uses a soft open-cell urethane sponge in view of its good rubbing characteristics for rubbing of ink into the screen 110.

The powdery ink 130 supplied from the hopper 140 is pushed out downwardly through the mesh 111 of the screen 110 by rotation of the brush 120. A high direct-current voltage is applied between the object 100 and the screen 110 by a direct-current power supply DC to form an electrostatic field between the object 100 and the screen 110. The powdery ink which has passed through the mesh 111 and has thus been charged travels straight toward the object 100, which serves as a counter electrode, in the electrostatic field and is attached to a surface of the object 100. Thus, a printed pattern in the screen 110 which includes characters and figures is printed on the surface of the object 100.

When the powdery ink is rubbed into the screen 110, the powdery ink is heated due to pressure applied by the brush 120 and frictional heat. Therefore, if a printing process is continuously performed with powdery ink containing oils and fats, for example, then the temperature of the powdery ink may be increased to not less than the melting points of the oils and fats, and the powdery ink may be melted. When the melted ink is cooled, it solidifies on a surface of the screen 110, thereby causing clogging of the mesh 111 formed in the screen 110. Accordingly, with the conventional electrostatic printing apparatus, it is necessary to interrupt the printing process to perform a cleaning process of the screen 110 in order to prevent the clogging of the mesh 111, and thus the apparatus cannot be operated continuously.

Further, according to the printed pattern in the screen 110, the consumption of the powdery ink may be different from one location to another on the screen 110. In such a case, there is a large tendency that the amount of the powdery ink on the screen 110 is reduced at locations where the consumption of the powdery ink is large, while there is a large tendency that the powdery ink is accumulated on the screen 110 at locations where the consumption of the powdery ink is small. In this manner, since the distribution of the amount of ink is not uniform at locations on the screen 110, uniform and clean printing cannot be achieved in some cases.

Here, if the amount of ink 130 to be supplied from the hopper 140 is adjusted according to the consumption of ink, then non-uniform printing described above can be solved. However, it is difficult to vary the amount of ink 130 to be supplied from the hopper 140 according to locations on the screen 110. Furthermore, even if the amount of ink 130 to be supplied can be adjusted according to the consumption of ink, the amount of ink to be supplied has to be readjusted each time the printed pattern in the screen 110 is changed, thereby causing considerably troublesome work.

Furthermore, a portion of the powdery ink that has passed through the mesh 111 may not travel toward the object 100 and may be attached to a lower surface of the screen 110. If the ink is attached to the lower surface of the screen 110, then the mesh 111 is gradually clogged with the ink on the lower surface of the screen 110, and thus the ink is unlikely to be pushed out through the mesh 111 so as to cause defective printing. As a result, a cleaning device 150 shown in FIG. 8 has heretofore been provided to remove ink attached to the lower surface of the screen 110. As shown in FIG. 8, the conventional cleaning device 150 has a suction nozzle 151 and rubber pieces 152 which are brought into contact with the lower surface of the screen 110, and draws the ink attached to the lower surface of the screen 110 from the suction nozzle 151.

When such a cleaning device 150 is employed, strong suction force is required to draw ink attached to the lower surface of the screen 110. When the suction force of the cleaning device 150 is large, ink near the mesh 111 on an upper surface of the screen 110 may unnecessarily be drawn and removed. If the amount of ink near the mesh 111 is reduced, then the distribution of ink on the screen 110 becomes non-uniform so as to produce light and shade in a printed object. Additionally, the ink excessively drawn from the upper surface of the screen 110 results in a loss.

DISCLOSURE OF INVENTION

The present invention has been made in view of the above drawbacks of the prior art. It is, therefore, an object of the present invention to provide an electrostatic printing apparatus and an electrostatic printing method which can operate the apparatus continuously and achieve uniform and clean printing.

In order to solve the above drawbacks of the prior art, according to an aspect of the present invention, there is provided an electrostatic printing apparatus for rubbing powdery ink into a screen having a predetermined printed pattern formed therein, and for applying a voltage between the screen and an object so as to attach the powdery ink to the object, the electrostatic printing apparatus characterized by comprising a soft brush to rub the powdery ink into the screen and a hard brush to remove powdery ink solidified on a surface of the screen.

With this arrangement, the powdery ink can be rubbed into the screen by the soft brush, and simultaneously the powdery ink solidified on the surface of the screen can be removed by the hard brush. Therefore, it is possible to prevent clogging of the printed pattern in the screen while maintaining good rubbing characteristics for rubbing of the powdery ink into the screen. Accordingly, it becomes unnecessary to interrupt the printing process to perform a cleaning process for cleaning of the screen, so that the apparatus can be operated continuously.

In this case, it is desirable that the hard brush comprises a hard open-cell urethane sponge, and the soft brush comprises a soft open-cell urethane sponge.

According to another aspect of the present invention, there is provided an electrostatic printing apparatus for rubbing powdery ink into a screen having a predetermined printed pattern formed therein, and for applying a voltage between the screen and an object so as to attach the powdery ink to the object, the electrostatic printing apparatus characterized by comprising a cleaning brush to wipe off powdery ink from a lower surface of the screen and an evacuator to evacuate powdery ink attached to the cleaning brush.

With this arrangement, when cleaning is performed on the lower surface of the screen, powdery ink present on the upper surface of the screen is not removed. Therefore, the amount of ink on the screen can be maintained uniform to achieve uniform and clean printing. Further, since the powdery ink is not excessively removed, it is possible to minimize a loss of the powdery ink.

In this case, it is desirable that the cleaning brush is cylindrical and comprises an open-cell urethane sponge.

According to another aspect of the present invention, there is provided an electrostatic printing apparatus for rubbing powdery ink into a screen having a predetermined printed pattern formed therein, and for applying a voltage between the screen and an object so as to attach the powdery ink to the object, the electrostatic printing apparatus characterized by comprising a cleaning member to scrape down powdery ink on a lower surface of the screen and a container to recover the powdery ink scraped down by the cleaning member.

With this arrangement, since dust in the air is prevented from being mixed in the recovered powdery ink, powdery ink recovered by the container can be reused even if edible powdery ink or the like is used.

According to another aspect of the present invention, there is provided an electrostatic printing apparatus for rubbing powdery ink into a screen having a predetermined printed pattern formed therein, and for applying a voltage between the screen and an object so as to attach the powdery ink to the object, the electrostatic printing apparatus characterized by comprising a screen brush to rub the powdery ink into the screen, a first moving mechanism for moving the screen brush in a first direction, and a second moving mechanism for moving the screen brush in a second direction perpendicular to the first direction.

With this arrangement, it is possible to rub powdery ink into the screen while moving the screen brush simultaneously in the first direction and in the second direction perpendicular to the first direction. Therefore, it is possible to spread the powdery ink entirely on the screen even if the consumption of the powdery ink is different from one location to another on the screen. Accordingly, the amount of ink can be made uniform on the screen without a complicated control of the amount of ink to achieve uniform and clean printing.

According to another aspect of the present invention, there is provided an electrostatic printing method of rubbing powdery ink into a screen having a predetermined printed pattern formed therein with a brush and applying a voltage between the screen and an object so as to attach the powdery ink to the object, the electrostatic printing method characterized by rubbing the powdery ink into the screen while moving the brush in a first direction and moving the brush in a second direction perpendicular to the first direction.

BRIEF DESCRIPTION OF DRAWINGS

FIG. 7 is a schematic diagram showing an arrangement of a conventional electrostatic printing apparatus; and FIG. 8 is a cross-sectional view showing an arrangement of a cleaning device in a conventional electrostatic printing apparatus.

BEST MODE FOR CARRYING OUT THE INVENTION

An electrostatic printing apparatus according to embodiments of the present invention will be described below in detail with reference to FIGS. 1 through 6.

Figure 1:
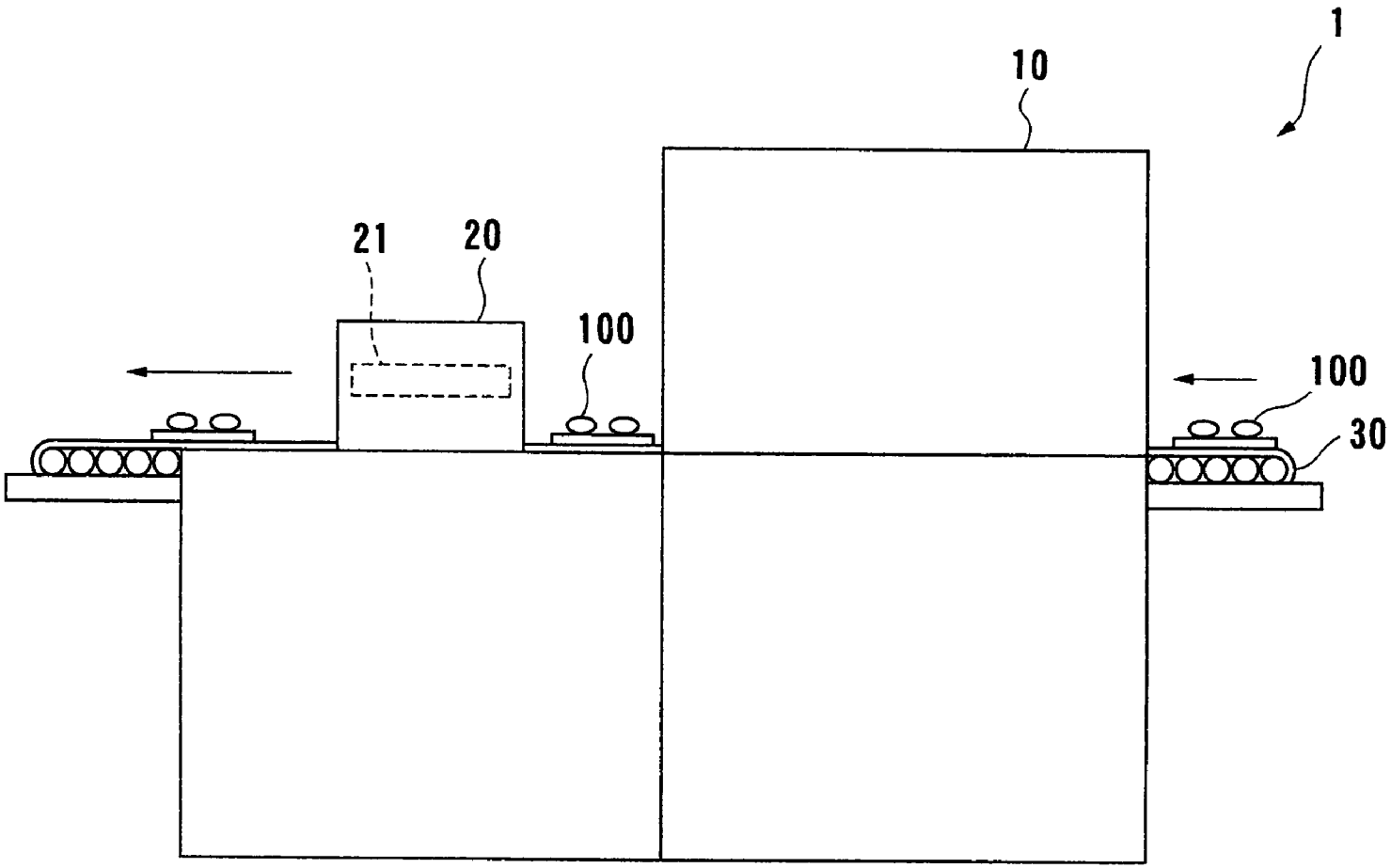
FIG. 1 is a front view showing an entire arrangement of an electrostatic printing apparatus according to an embodiment of the present invention.

FIG. 1 is a front view showing an entire arrangement of an electrostatic printing apparatus according to an embodiment of the present invention. As shown in FIG. 1, the electrostatic printing apparatus 1 comprises a printing section 10 for attaching powdery ink onto a surface of an object 100 such as confectionery, a fixing section 20 for fixing the powdery ink attached onto the surface of the object 100, and a belt conveyer 30 for conveying the object 100. A fixing means 21 such as a heater is provided within the fixing section 20. The object 100 is not limited to food such as confectionery and may comprise industrial goods. As the powdery ink, it is possible to use various kinds of powder, such as edible ink containing natural pigment or synthetic pigment, cocoa powder, wheat powder, tea powder, and industrial powdery ink, according to an intended use.

Figure 2:
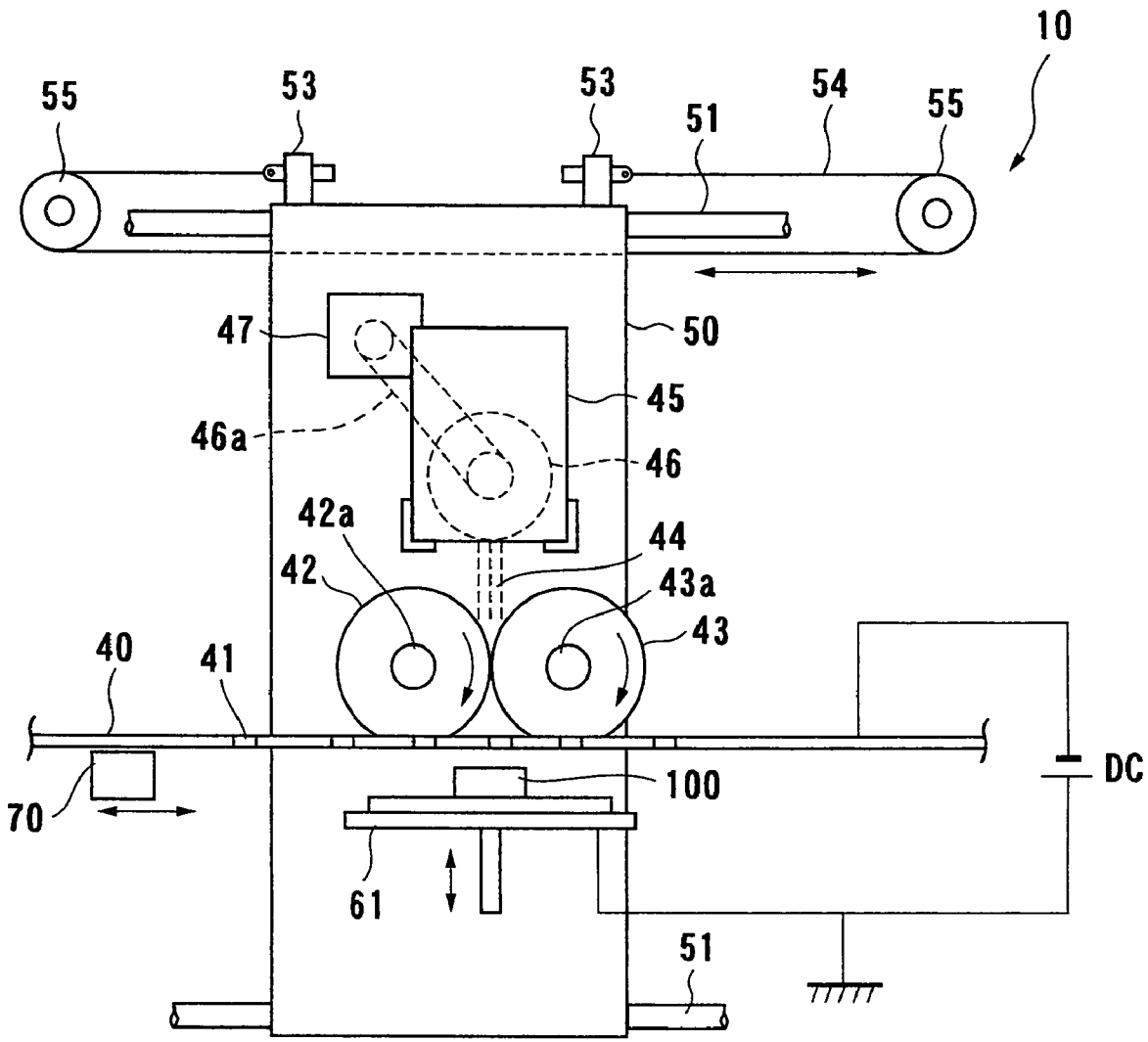
FIG. 2 is a front view showing a printing section of FIG. 1.
Figure 3:
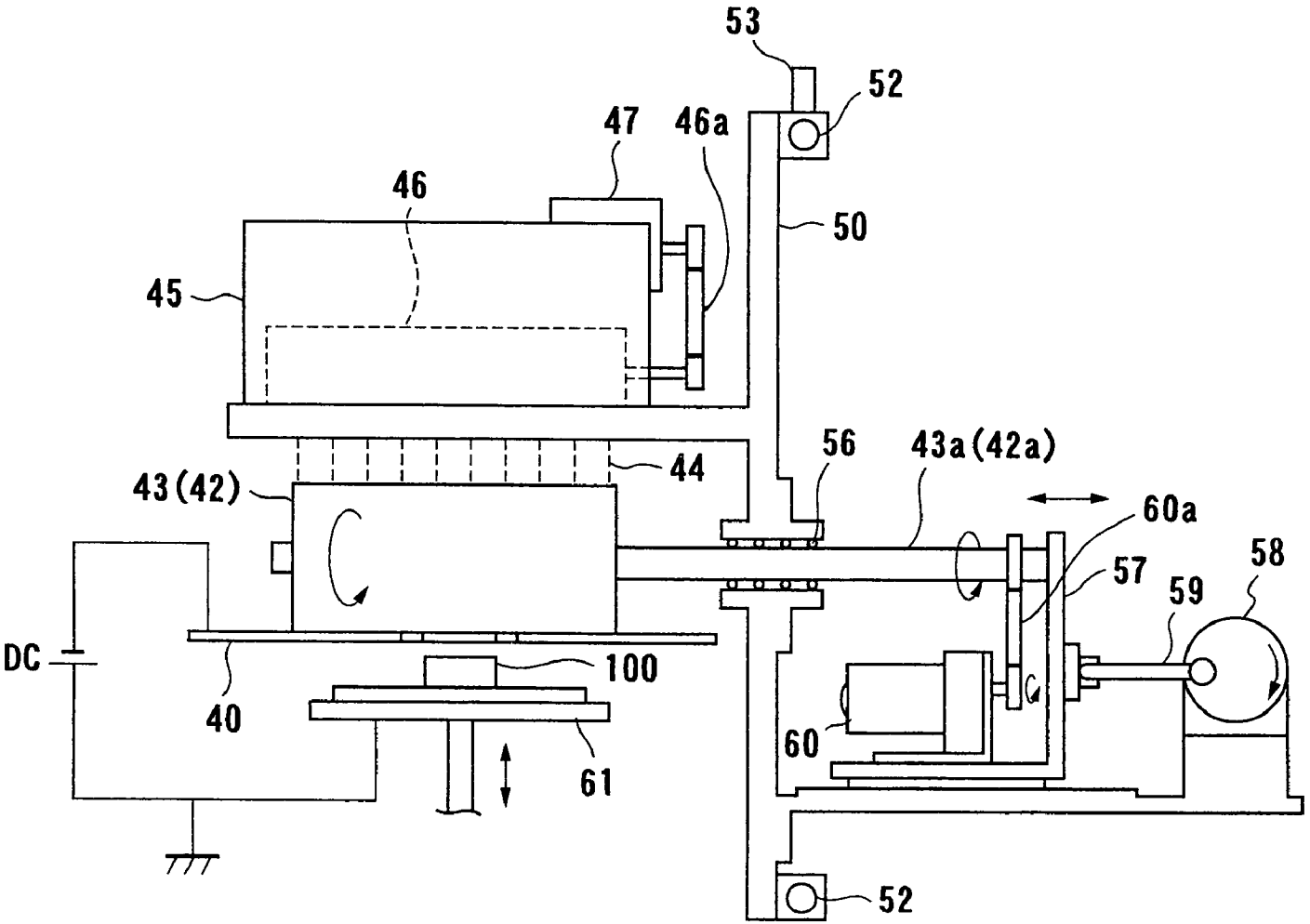
FIG. 3 is a side view showing the printing section of FIG. 1.

FIG. 2 is a front view showing the printing section 10 of FIG. 1, and FIG. 3 is a side view thereof. As shown in FIGS. 2 and 3, a stencil screen 40 made of a conductive material is disposed in the printing section 10. A printed pattern including characters and figures is formed of a mesh 41 on the screen 40. Further, the screen 40 is connected to a direct-current power supply DC.

Two cylindrical screen brushes, i.e., a soft open-cell urethane sponge brush 42 and a hard open-cell urethane brush 43, are disposed on the screen 40, and these screen brushes 42 and 43 are arranged so as to be brought into contact with an upper surface of the screen 40. Above the screen brushes 42 and 43 is disposed a hopper 45 for supplying powdery ink 44 onto the screen brushes 42 and 43. The powdery ink 44 is introduced into the hopper 45 through an upper portion of the hopper 45. The hopper 45 houses a hopper brush 46 therein, and the hopper brush 46 is coupled to a hopper brush rotation motor 47 via a belt 46*a*. Further, ink holes (not shown) are formed in a bottom of the hopper 45 for applying the introduced powdery ink 44 onto the screen brushes 42 and. 43. By actuating the hopper brush rotation motor 47 to rotate the hopper brush 46 after the powdery ink 44 is introduced into the hopper 45 through the upper portion of the hopper 45, the powdery ink 44 is applied onto the screen brushes 42 and 43 through the ink holes.

The hopper 45 is fixed to a frame 50, which is movable along a direction in which the belt conveyer 30 moves (hereinafter referred to as a flowing direction). The frame 50 has rail holes 52 and 52 formed in an upper end portion and a lower end portion of the frame 50, into which rails 51 and 51 are inserted. Ends of a belt 54 are connected to connecting portions 53 and 53 projecting upward from an upper portion of the frame 50. The belt 54 is stretched between two pulleys 55 and 55, and the frame 50 can be moved in the flowing direction by rotation of the pulleys 55 and 55.

Screen brush shafts 42*a* and 43*a* are inserted into the frame 50 via bearings 56. Each end of the screen brush shafts 42*a* and 43*a* is rotatably connected to a sliding base 57, which can slide with respect to the frame 50. A screen brush rotation motor 60 is provided on the sliding base 57, and the screen brush shafts 42*a* and 43*a* are coupled to the screen brush rotation motor 60 via a belt 60*a*. The screen brushes 42 and 43 can be rotated about their axes by actuation of the screen brush rotation motor 60.

Further, a crank motor 58 is provided on the frame 50. The sliding base 57 is coupled to the crank motor 58 via a crank arm 59. The sliding base 57 and the screen brushes 42 and 43 connected thereto can be moved in a direction of the screen brush shaft, i.e., a direction perpendicular to the flowing direction, by actuation of the crank motor 58.

A lifter 61, which can be raised and lowered, is disposed below the screen 40, and the object 100 on the belt conveyer 30 can be lifted to the vicinity of the screen 40 by raising the lifter 61 below the belt conveyer 30. A surface of the lifter 61 on which the object 100 is placed has a ground potential, and a high direct-current voltage, e.g., a high voltage of 5000 to 6000 V, is applied between the screen 40 and the lifter 61 by a direct-current power supply DC.

Figure 4:
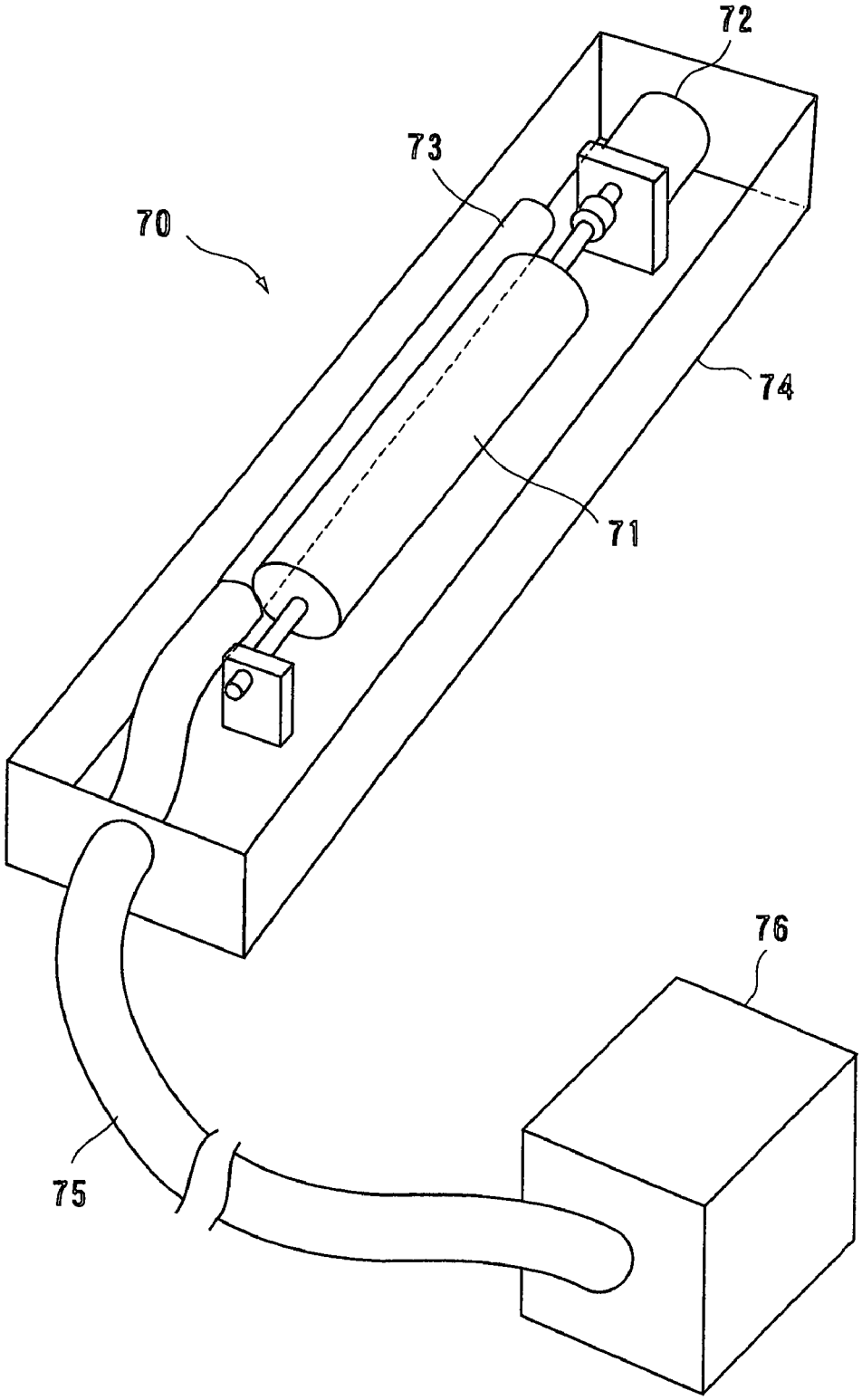
FIG. 4 is a perspective view showing a cleaning device and an evacuator of FIG. 2.
Figure 5:
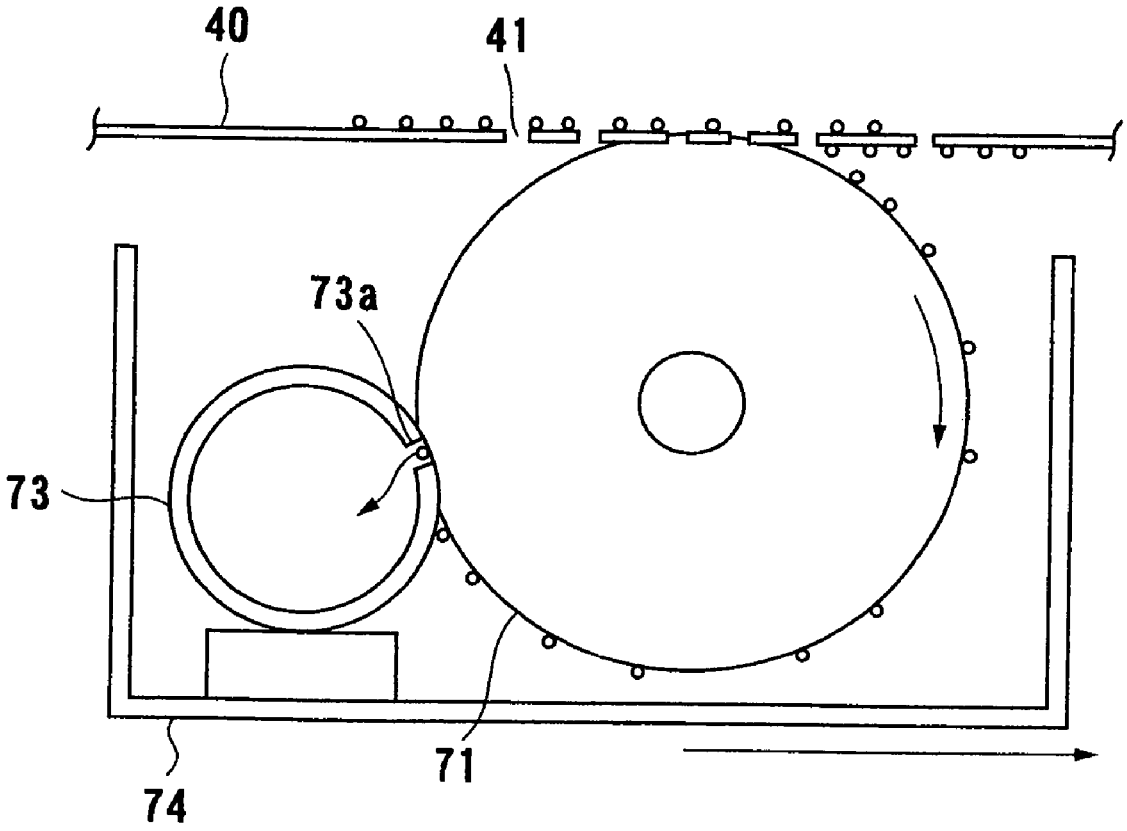
FIG. 5 is a vertical cross-sectional view showing the cleaning device of FIG. 2.

A cleaning device 70, which is movable in the flowing direction, is disposed below the screen 40. FIG. 4 is a perspective view showing the cleaning device 70 of FIG. 2, and FIG. 5 is a cross-sectional view thereof. As shown in FIG. 4, the cleaning device 70 has a cylindrical cleaning brush 71 made of an open-cell urethane sponge, a cleaning brush rotation motor 72 for rotating the cleaning brush 71, and a vacuum pipe 73. These components are housed in a rectangular parallelepiped container 74. The container 74 is movable in the flowing direction by a moving mechanism, which is not shown.

As shown in FIG. 5, an upper portion of the cleaning brush 71 is brought into contact with a lower surface of the screen 40, and unnecessary powdery ink attached onto the lower surface of the screen 40 is wiped off by the cleaning brush 71 due to rotation of the cleaning brush rotation motor 72 and movement of the cleaning device 70 in the flowing direction. Further, the vacuum pipe 73 has a suction port 73*a* formed at a portion contacting the cleaning brush 71, and the vacuum pipe 73 is connected through a pipe 75 to an evacuator 76. Thus, the powdery ink wiped off by the cleaning brush 71 is evacuated through the suction port 73*a* in the vacuum pipe 73 to the evacuator 76.

Next, operation of the electrostatic printing apparatus thus constructed will be described.

The object 100 such as confectionery placed on the belt conveyer 30 is introduced into the printing section 10. Then, when the object 100 is moved to a position above the lifter 61, the lifter 61 is lifted to lift the object 100 to the vicinity of the screen 40. In that state, the following printing process is performed.

In a printing process, the hopper brush rotation motor 47 is actuated to rotate the hopper brush 46. Further, the screen brush rotation motor 60 is actuated to rotate the screen brushes 42 and 43. The powdery ink 44 is applied onto the screen brushes 42 and 43 by rotation of the hopper brush 46, and the powdery ink 44 is delivered to an upper surface of the screen 40 by rotation of the screen brushes 42 and 43. The frame 50 and the screen brushes 42 and 43 are moved in the flowing direction by rotation of the pulleys 55.

Here, the screen brush 42 comprises a soft open-cell urethane sponge brush, which has good rubbing characteristics for rubbing of powdery ink 44 into the screen 40. Therefore, the powdery ink can sufficiently be rubbed into the screen 40 by pressing the soft screen brush 42 against the screen 40 and rotating the soft screen brush 42. On the other hand, the screen brush 43 comprises a hard open-cell urethane sponge brush. Therefore, ink solidified on the surface of the screen 40 can be removed by pressing the hard screen brush 43 against the screen 40 and rotating the hard screen brush 43. Thus, according to an electrostatic printing apparatus of the present invention, it is possible to prevent clogging of the mesh 41 in the screen 40 while maintaining good rubbing characteristics for rubbing of powdery ink into the screen 40. Therefore, it becomes unnecessary to interrupt the printing process to perform a cleaning process for cleaning the screen 40, and hence the apparatus can be operated continuously.

At the same time, a high direct-current voltage of, for example, 5000 to 6000 V, is applied between the screen 40 and the lifter 61 by the direct-current power supply DC to form an electrostatic field between the screen 40 and the lifter 61. The powdery ink 44 is rubbed into the screen 40 mainly by rotation of the screen brush 42 and pushed out downwardly through the mesh 41. The powdery ink 44 which has passed through the mesh 41 and has thus been charged (negatively in the present embodiment) is accelerated toward the lifter 61 serving as a counter electrode, i.e., the object 100, and is attached onto the object 100.

Figure 6:
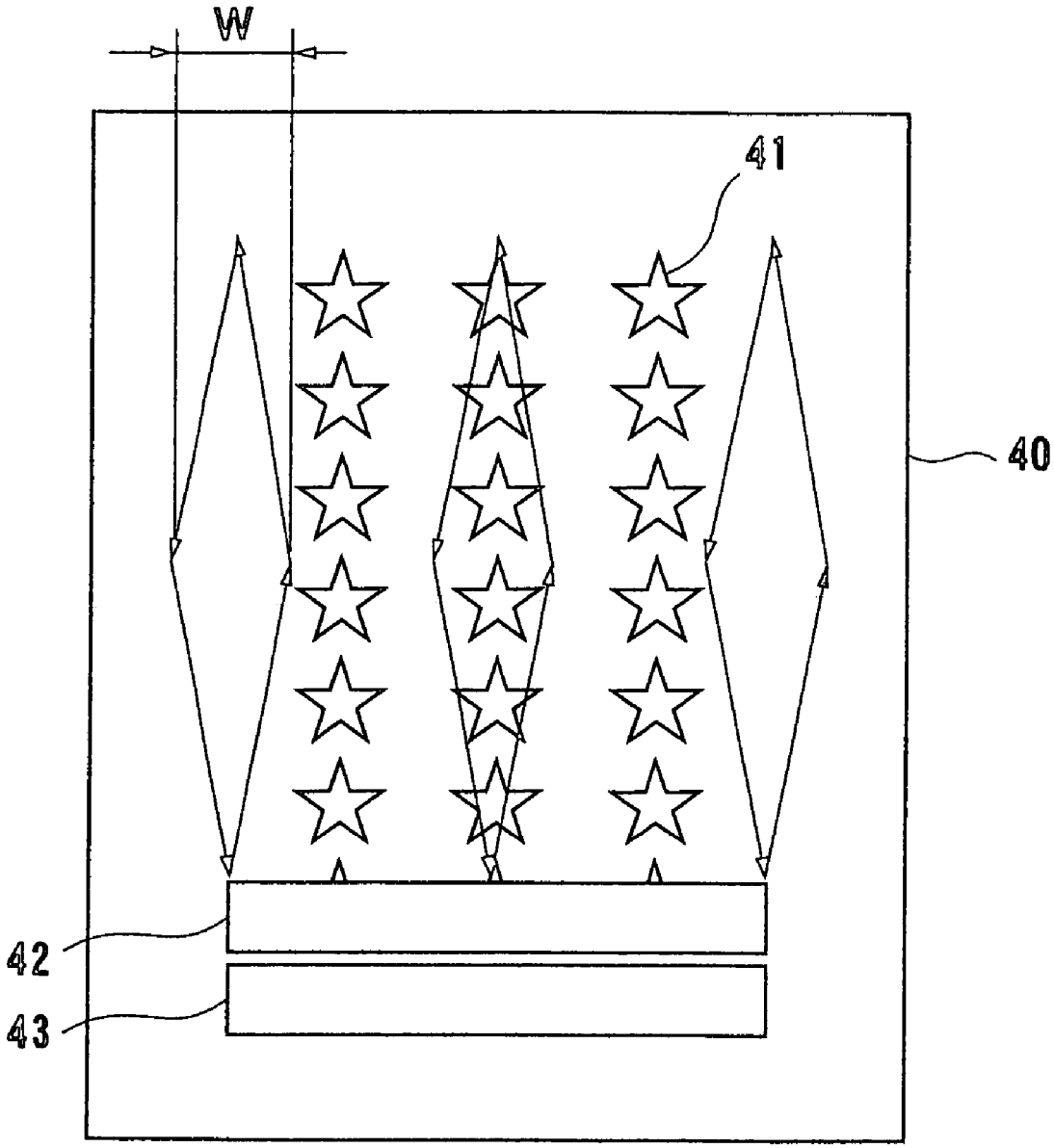
FIG. 6 is a plan view explanatory of movement of a screen brush in an electrostatic printing apparatus according to an embodiment of the present invention.

Here, in the electrostatic printing apparatus according to the present invention, the printing process is performed while the screen brushes 42 and 43 are being moved not only in the flowing direction, but also in a direction perpendicular to the flowing direction. Specifically, the crank motor 58 is actuated to move the sliding base 57 and the screen brushes 42 and 43 in a direction of the screen brush shafts 42*a* and 43*a* during the printing process. Thus, by moving the screen brushes 42 and 43 in two directions including the flowing direction and the brush axis direction, it is possible to move the screen brushes 42 and 43 so as to trace a pattern as shown in FIG. 6, for example. This movement allows the powdery ink to be spread entirely on the screen 40 even if the consumption of the powdery ink is different from one location to another on the screen 40. Therefore, the amount of ink can be made uniform on the screen 40 without a complicated control of the amount of ink to achieve uniform and clean printing. The width W of movement in the brush axis direction should preferably be designed such that the screen brushes are moved from locations where the consumption of the powdery ink is small to locations where the consumption of the powdery ink is large.

After the powdery ink is attached to the surface of the object 100, the lifter 61 is lowered to place the object 100 onto the belt conveyer 30, and the object 100 is delivered to the fixing section 20. Between the time when the lifter 61 is lowered and the time when the next object 100 is moved to a position above the lifter 61, the powdery ink on the lower surface of the screen 40 is removed by the cleaning device

70. Specifically, the cleaning brush 71 of the cleaning device 70 is moved in the flowing direction while it is brought into contact with the lower surface of the screen 40. At the same time, the cleaning brush rotation motor 72 is actuated to rotate the cleaning brush 71. The powdery ink attached to the lower surface of the screen 40 is wiped off by the cleaning brush 71 being rotated. The powdery ink which has been wiped off is delivered to the suction port 73*a* of the vacuum pipe 73 by rotation of the cleaning brush 71 and evacuated through the suction port 73*a* by the evacuator 76.

Thus, the cleaning device 70 in the electrostatic printing apparatus according to the present invention does not evacuate the powdery ink attached to the lower surface of the screen 40, but wipes the powdery ink off with the cleaning brush 71. Therefore, the powdery ink present on the upper surface of the screen 40 is not removed. Accordingly, the amount of ink on the screen 40 can be maintained uniform to achieve uniform and clean printing. Further, since the powdery ink is not excessively removed, it is possible to minimize a loss of the powdery ink. Furthermore, in the present embodiment, since the cleaning brush 71 comprises an open-cell urethane sponge, it can wipe off powdery ink finer than powdery ink that can be wiped off by a conventional device.

Here, the evacuator 76 of the cleaning device 70 may evacuate not only powdery ink, but also dust in the air. Therefore, when edible powdery ink or the like is used, powdery ink evacuated and recovered by the evacuator 76 cannot be reused. In such a case, instead of the cleaning brush 71, the powdery ink attached to the lower surface of the screen 40 may be scraped down by a spatulate cleaning member made of rubber or the like, and the powdery ink that is scraped down may be recovered by a container disposed below the cleaning member so that the recovered powdery ink can be reused.

The object 100 delivered to the fixing section 20 is heated by a fixing means 21 such as a heater provided in the fixing section 20, and the powdery ink attached to the surface of the object 100 is fixed by heating. The fixing means is not limited to a heater, and may also eject superheated steam to the object 100.

Although certain embodiments of the present invention have been described, the present invention is not limited to the aforementioned embodiments. It should be understood that various changes and modifications may be made therein without departing from the scope of the technical concept.

INDUSTRIAL APPLICABILITY

The present invention is suitable for use in an electrostatic printing apparatus for attaching powdery ink onto a surface of an object by using an electrostatic force to print a printed pattern including characters and figures on the surface of the object.

What is claimed is:

1. An electrostatic printing apparatus for rubbing powdery ink containing oil and fat into a screen having a predetermined printed pattern formed therein, and for applying a voltage between said screen and an object so as to attach the powdery ink to the object, said electrostatic printing apparatus comprising:

a soft brush to rub the powdery ink into said screen; and a hard brush to remove powdery ink solidified on a surface of said screen, said hard brush being positioned on the same side of said screen as said soft brush.

2. The electrostatic printing apparatus as recited in claim 1, wherein said hard brush comprises a hard open-cell urethane sponge.

3. The electrostatic printing apparatus as recited in claim 1, wherein said soft brush comprises a soft open-cell urethane sponge.

4. An electrostatic printing apparatus for rubbing powdery ink into a screen having a predetermined printed pattern formed therein, and for applying a voltage between said screen and an object so as to attach the powdery ink to the object, said electrostatic printing apparatus comprising:

a cleaning brush to wipe off powdery ink from a lower surface of said screen; and an evacuator having a suction port at a portion contacting an outer surface of said cleaning brush to evacuate powdery ink attached to said cleaning brush.

5. The electrostatic printing apparatus as recited in claim 4, wherein said cleaning brush is cylindrical.

6. An electrostatic printing apparatus for rubbing powdery ink into a screen having a predetermined printed pattern formed therein, and for applying a voltage between said screen and an object so as to attach the powdery ink to the object, said electrostatic printing apparatus comprising:

a cleaning member to scrape down powdery ink on a lower surface of said screen; and a container to recover the powdery ink scraped down by said cleaning member.

7. An electrostatic printing apparatus for rubbing powdery ink into a screen having a predetermined printed pattern formed therein, and for applying a voltage between said screen and an object so as to attach the powdery ink to the object, said electrostatic printing apparatus comprising:

a screen brush to rub the powdery ink into said screen by rotation;

a first moving mechanism for moving said screen brush in a direction perpendicular to a rotational axis of said screen brush; and a second moving mechanism for moving said screen brush in a direction along the rotational axis of said screen brush.

8. An electrostatic printing method of rubbing powdery ink into a screen having a predetermined printed pattern formed therein with a brush being rotated and applying a voltage between the screen and an object so as to attach the powdery ink to the object, said electrostatic printing method comprising:

rubbing the powdery ink into the screen while moving the brush in a direction perpendicular to a rotational axis of the brush and moving the brush in a direction along the rotational axis of said screen brush.

* * * * *